United States Patent [19]

Thornbloom, Jr.

[11] 3,979,007

[45] Sept. 7, 1976

[54] PICNIC COOLER

[75] Inventor: Bruce Norman Thornbloom, Jr., Clinton, Mass.

[73] Assignee: Bee Plastics Corporation, Chicago, Ill.

[22] Filed: Oct. 16, 1975

[21] Appl. No.: 623,014

[52] U.S. Cl. ..... 220/23; 190/12 R; 220/96; 220/335

[51] Int. Cl.[2] ..... B65D 25/04; B65D 25/28; B65D 43/16

[58] Field of Search ..... 220/9 R, 9 F, 23, 94 R, 220/96, 335; 190/10, 11, 12 R; 217/60 R; 206/540

[56] References Cited

UNITED STATES PATENTS

| | | | |
|---|---|---|---|
| 597,217 | 1/1898 | Loery | 220/94 R |
| 692,448 | 2/1902 | Jones | 220/335 |
| 1,494,165 | 5/1924 | Hall | 220/335 |
| 1,496,600 | 6/1924 | Rau | 220/94 R |
| 2,613,843 | 10/1952 | Suda | 217/60 R X |
| 2,663,392 | 12/1953 | Miller | 190/12 R |
| 2,936,066 | 5/1960 | Meksula | 220/23 R X |
| 3,450,431 | 6/1969 | Tyler | 220/335 X |
| 3,791,547 | 2/1974 | Branscum | 220/9 F X |
| 3,993,269 | 1/1976 | Mastrovito | 220/94 R |

FOREIGN PATENTS OR APPLICATIONS

| | | | |
|---|---|---|---|
| 448,639 | 5/1948 | Canada | 220/96 |

*Primary Examiner*—William Price
*Assistant Examiner*—Stephen Marcus
*Attorney, Agent, or Firm*—Jacques M. Dulin

[57] ABSTRACT

Improved combination lid and handle assembly for a picnic cooler having hinged, double-door lid sections, each of which cooperatingly engage a handle assembly in the raised position to support the inner surface of the lid sections in a horizontal position. This provides a table surface for the users. The handle sections have cooler side wall stops and recesses in the lid to retain the lid in the proper position preventing disengagement and spilling of objects placed on the inner table surfaces of the lid. The lid may also have recessed portions on the inner surface to receivingly retain glasses or other objects.

12 Claims, 6 Drawing Figures

PICNIC COOLER

FIELD

This invention refers to improvements in picnic-type coolers, particularly those having insulated walls, a pair of carrying handles and double-door-type hinged lids in which the lids and handles in combination cooperatingly engage in the open position to provide horizontal table or work space for the users. Object-retaining recesses may also be provided in the inner surface of the lids.

BACKGROUND

Picnic baskets have become increasingly useful by the relatively recent advent of the use of rigid foam plastic for insulation purposes. These picnic coolers typically are of rigid foamed polystyrene, and consist of a body, a lid and carrying handles applied to the body portion. Handles of the rigid foam cannot be made because the foam has insufficient strength. Further, the foam, while rigid, is soft and crumbles relatively easily in normal use.

More recently, picnic coolers have employed a double-wall construction of a blow-molded plastic in which insulation is placed. The insulation may be foamed in place and typically is of urethane composition. The outer plastic shell may be a polyolefin, such as polystyrene, polyethylene, polypropylene, an ABS resin or any other suitable type. Coolers of this construction are of better quality than the non-sheathed rigid foam type, but are considerably more expensive and difficult to construct.

Further, end-mounted handles for all types of coolers are of two basic types, short and long, and give rise to two problems. Short handles mounted on externally projecting brackets fold up parallel to and contact the side walls of the container on which they are mounted. When the cooler is carried loaded, the weight forces the hands of the person carrying the cooler into the side walls. If the cooler is of the rigid but soft foam type, the cooler as well as the knuckles of the person may be damaged. Where the cooler is of the hard, rigid external shell type, the knuckles of the person may be bruised; the cooler cannot be carried far or conveniently.

Long, side-mounted handles overcome the above problem as they extend above the surface of the lid of the cooler. However, in the down position the handles may extend below the bottom surface of the cooler. The handles must be stored at an angle to the side, and thus take more room. Further, the long handles cannot be used as lid props.

OBJECTS

It is among the objects of this invention to provide an improved handle and lid construction for containers, particularly picnic coolers, of the rigid foam or shell construction which overcomes the difficulties of the prior art and provides in combination additional useful functions.

It is another object to provide an improved short handle construction for containers which has knuckle space between the handle and container side wall for ease of carrying the loaded container and facilitates storage.

It is another object to provide an improved handle and lid construction for containers in which specially adapted handles cooperatingly engage lid sections to provide a horizontal inner surface of the lids when in the open position for work space.

It is another object to provide an improved double-door type hinged lid construction for containers that engages a supporting handle member as a prop.

It is another object to provide special stop means on a handle assembly, and a retaining lip and receiving groove assembly in a lid section of a container so that the lid inner surface is retained in a horizontal position when open to provide for work space, and the supporting handle is prevented from accidental disengagement.

Still further and other objects will be evident from the detailed description below which has reference to the drawings.

FIGURES

SUMMARY

Improved container construction, particularly useful with picnic type hampers or coolers, in which a specially adapted double-door-type hinged lid engages carrying handle members to support the lid section inner surfaces in a horizontal position in the open mode. The lid sections have formed therein a special angled, generally V-shaped groove for receiving the upper surface of a carrying handle, and a lip member to prevent the handle from falling outwardly when in the operative position. The cooperating handle is adapted in length to provide the appropriate horizontal orientation of the inner surface of the lid section. The handle member also has a stop member adjacent the hinge pins that have a dual function: First, they provide knuckle space for the person carrying the container. Second, they properly align the handle for engaging the lid groove. The handle stops are also adapted to not prevent storage of the handle adjacent the container wall in the lowered position.

DETAILED DESCRIPTION

The following detailed description is by way of example and not by way of limitation of the principles of the invention. The example herein is of a picnic cooler of the blow-molded, rigid, hard outer shell type having hollow inner spaces, some of which are filled with insulation, but the invention may be used with rigid (soft) foam-type coolers or other containers.

Figure 1:
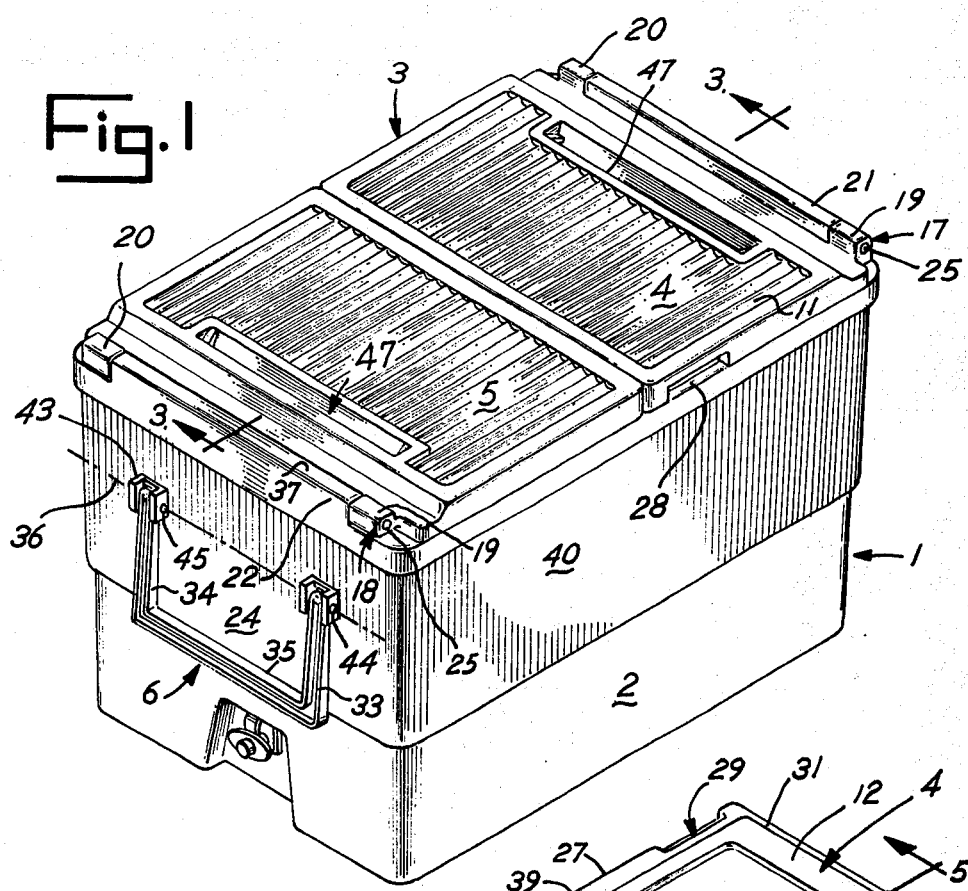
FIG. 1 illustrates in perspective an improved container of the present invention, particularly showing a picnic cooler having double-door-type hinged lids in the closed position.
Figure 2:
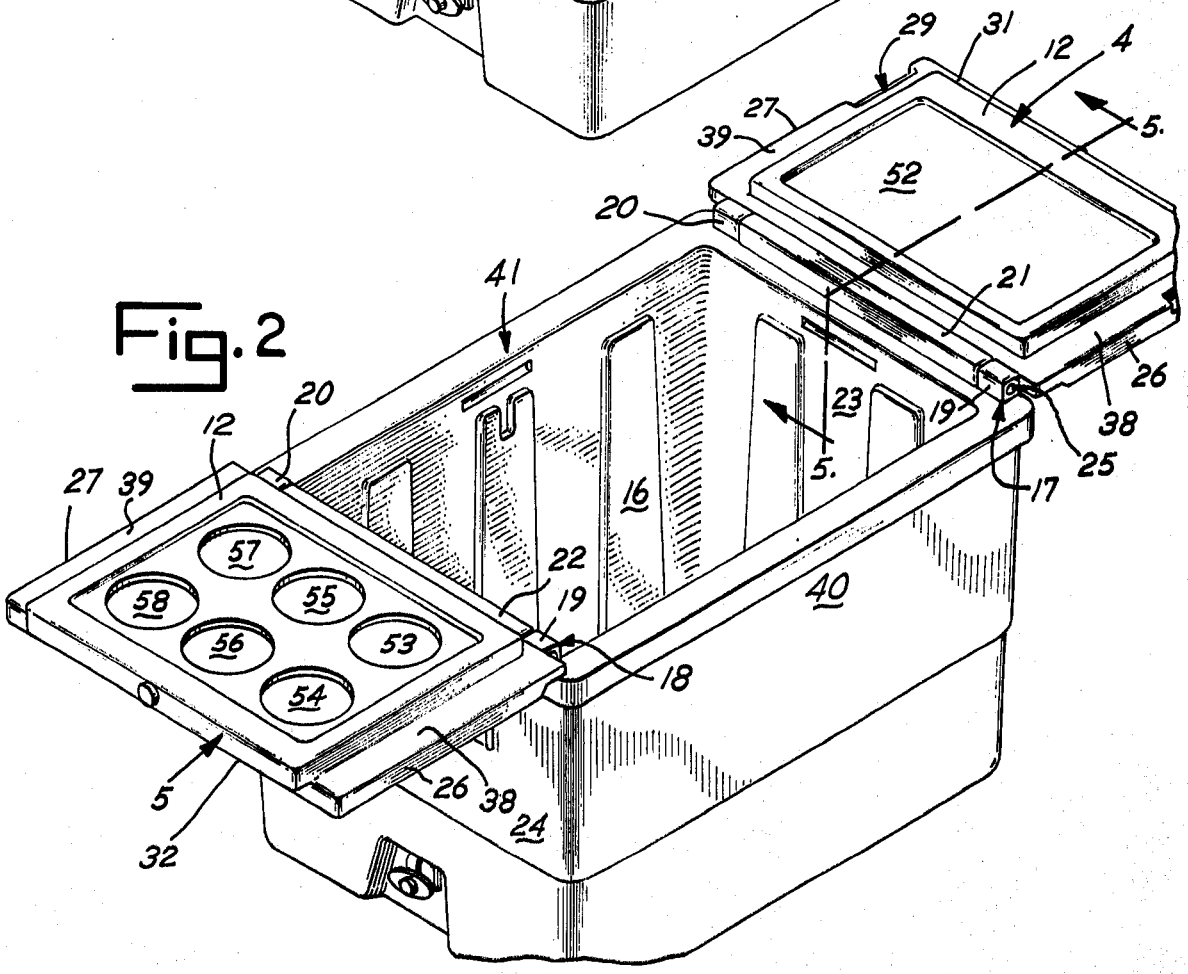
FIG. 2 shows the hamper or cooler of FIG. 1 in perspective with the lid sections in the open position and supported by the handles.
Figure 3:
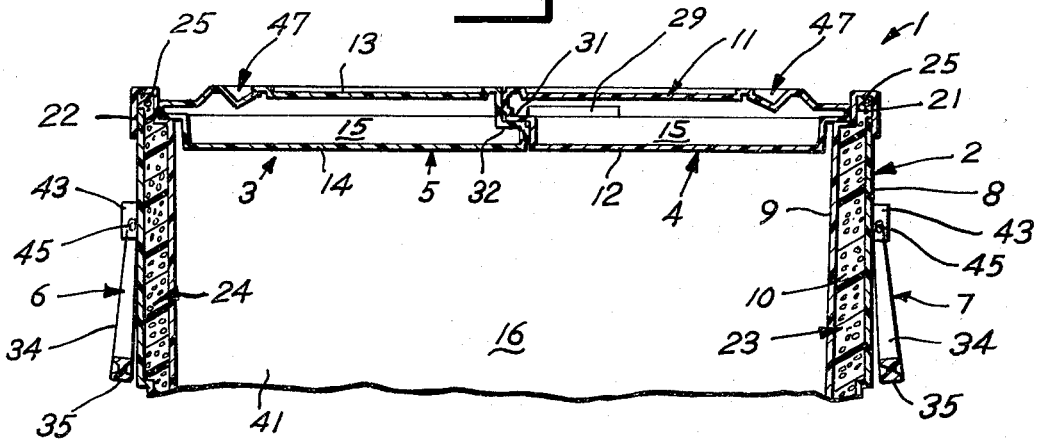
FIG. 3 is a section view of the cooler along line 3—3 of FIG. 1.

In FIGS. 1, 2, and 3, container 1 has a body portion 2, a double-door hinged lid 3 having sections 4, 5, and a pair of carrying handles 6, 7 (FIG. 3). The body is of a double-walled, blow-molded construction having outer wall 8 and inner wall 9, between which is insulation 10. The lid sections may be blow-molded or solid, and have an outer surface 11 and an inner surface 12. In the example shown the lids are blow-molded, rigid plastic having an outer wall 13 and an inner wall 14, between which is a hollow, insulating space 15. The body walls, floor and lid define a container volume or space 16 for retaining articles.

The lid sections are pivoted on hinge members 17 and 18, which typically comprise lugs 19, 20 molded integrally into the lid sections, and mating rib members 21, 22 molded into the end walls 23, 24 of the body. The end faces of the rib and lugs are apertured to receive hinge pin 25.

The lid sections extend outwardly of the inner wall surfaces of the container in marginal flanges 26, 27 a portion of which on one lid is recessed or relieved in a manner adapted to provide a hand hold 20, 29 for opening the lid section 4. Only the lid section 4 has the recesses to insure that it is opened first. The marginal surfaces 38, 39 are supported along the upper surfaces of side walls 40, 41. The lid section 5 is opened second by grasping it in the center 30 after lid section 4 is opened (see FIG. 4 for sequence). The lid sections have mating shoulders 31, 32 for further lid support, to insure proper opening sequence, and to promote better insulation.

The handles 6 and 7 have arms 33, 34 joined by lifting member crosspiece 35. The arms 33, 34 are approximately equal to or shorter in length than the distance of the handle pivot axis 36 is to the top surface of the container and are positioned on the container end walls so that in the folded-down position (FIGS. 1 and 3) the handle crosspiece is above the bottom surface of the container body. Each arm of the handle is apertured and received in an apertured bracket 42, 43. The handle pivots on pins 44, 45.

Figure 4:
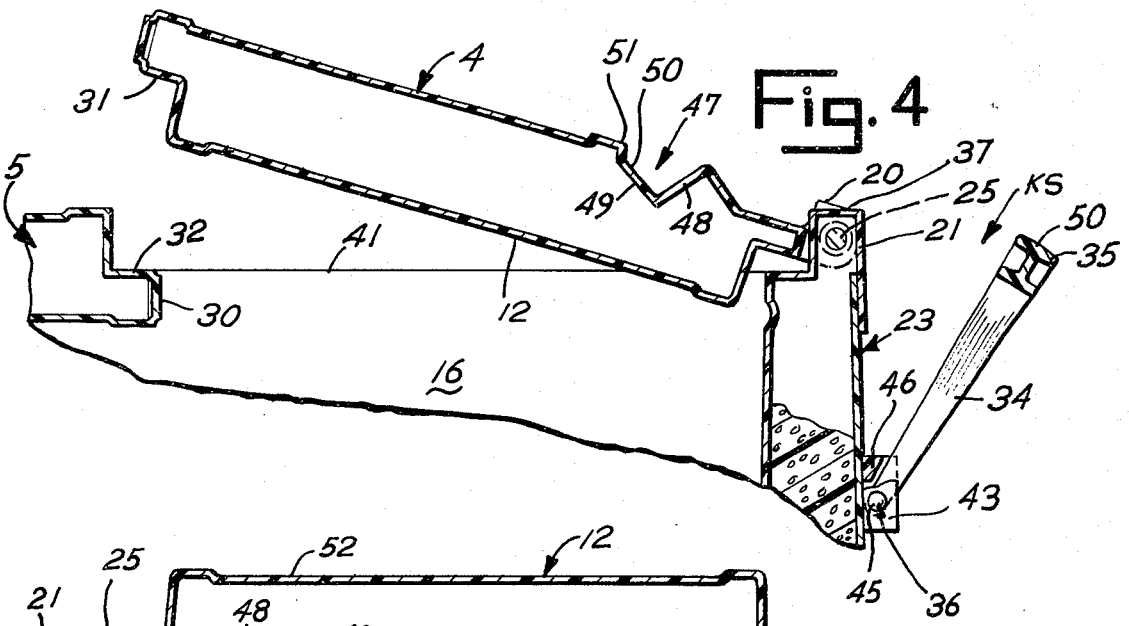
FIG. 4 is an enlarged section view of one lid section being opened and the handle in the carrying position ready to support the opened lid.
Figure 5:
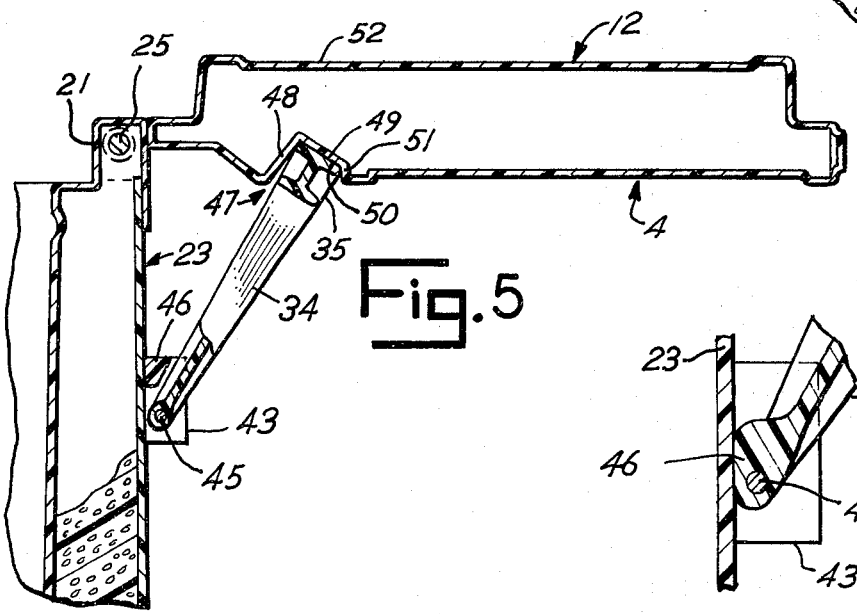
FIG. 5 is an enlarged section view of one lid section fully opened to provide a horizontal work surface as lockingly engaged with and supported by the carrying handle.
Figure 6:
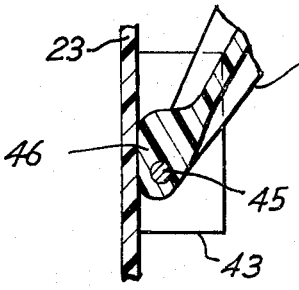
FIG. 6 shows an enlarged view, partly in section, of an alternate handle arm embodiment.

As best seen in FIGS. 4 and 5, the handle brackets also have a special wedge-shaped stop member 46 which prevents further rotary movement of the handle (counter-clockwise in FIGS. 4 and 5) toward the side wall of the container, but does not prevent folding down of the handle (clockwise motion of handle 7 in FIG. 3). This provides space KS (FIG. 4) between the handle crosspiece 35 and the body end wall 23 for the hand of the carrier, and prevents barking of the knuckles on the side walls or top when the container is being carried. Optionally, the stop member 46 may be an integral part of the handle arms 33, 34 as shown in enlarged partial section in FIG. 6. This stop member also cooperates with the handle and lid to space the handle crosspiece 35 in the proper position to be received into the groove 47, thereby supporting the inner lid surface 12 in a horizontal position as a table or work area (FIGS. 2 and 5).

The lid groove 47 is generally V-shaped and comprises a stop shoulder 48 which prevents incorrect positioning of the handle as a prop support, a support surface 49 which matingly engages the upper surface 50 of the crosspiece 35, and a locking shoulder 51 which prevents the handle from falling out or being accidentally knocked out of the groove (clockwise in FIG. 5) while the lid is being supported in the open (horizontal) position.

The lid may also have one or more types of recesses, e.g., flat recess 52 which functions to keep objects from sliding or rolling off the shelf and moisture (from cold objects sweating on humid days) from flowing off the shelf into the cooler. Another type are circular recesses 53, 54, 55, 56, 57, 58 (FIG. 2) which are for glasses, beer cans or the like. The lids may each have both circular and rectangular recesses in their interior surfaces.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

PARTS LIST

Case No. 75,617
Thornbloom

| | |
|---|---|
| 1. Container (picnic cooler | 30. Center section of lid 5 |
| 2. Body | 31. Lid shoulder |
| 3. Hinged lid, double door type | 32. Lid shoulder |
| 4. Lid section | 33. Arm of handle |
| 5. Lid section | 34. Arm of handle |
| 6. Carrying handle | 35. Crosspiece of handle |
| 7. Carrying handle | 36. Handle pivot axis |
| 8. Outer body wall | 37. Top of container |
| 9. Inner body wall | 38. Surface of lid margins |
| 10. Insulation | 39. Surface of lid margins |
| 11. Outer lid surface | 40. Side wall of body |
| 12. Inner lid surface | 41. Side wall of body |
| 13. Lid outer wall | 42. Handle bracket |
| 14. Inner lid wall | 43. Handle bracket |
| 15. Insulating space in lid | 44. Handle pivot pin |
| 16. Container space | 45. Handle pivot pin |
| 17. Hinge | 46. Handle stop |
| 18. Hinge | 47. Lid groove |
| 19. Lug on lid | 48. Stop shoulder |
| 20. Lug on lid | 49. Support surface |
| 21. Body rib | 50. Top surface of handle crosspiece |
| 22. Body rib | 51. Locking shoulder |
| 23. End wall | 52. Recess |
| 24. End wall | 53. Circular recess |
| 25. Hinge pin | 54. Circular recess |
| 26. Lid marginal flanges | 55. Circular recess |
| 27. Lid marginal flange | 56. Circular recess |
| 28. Hand hold in lid | 57. Circular recess |
| 29. Hand hold in lid | 58. Circular recess |

I claim:

1. An improved container having a lid and handle assembly comprising:

a. a container body having walls and a bottom defining therebetween a useful volume;

b. at least one lid having an inside and an outside surface, said lid being pivotally mounted on one of said walls;

c. at least one handle pivotally mounted on one of said walls;

d. said pivotal handle mounting being adapted to provide for motion of said handle through an arc from a first, lowered position to a second, raised position;

e. said handle having a cross member and at least one depending arm;

f. first means for limiting the rotational motion of said arm disposed in cooperating relation to said arm and said wall to space said crosspiece from said wall a distance sufficient to prevent discomfort of the hand of a person carrying said container by said handle;

g. second means for cooperatingly engaging said handle crosspiece when in said raised position, said engaging means being disposed in association with the outside surface of said lid;

h. third means for preventing outward and downward rotational motion of said handle and to retain said lid in a substantially horizontal position thereby providing a useful work space on said inner surface of said lid when said lid is in the open position, said third, handle motion preventing means being disposed adjacent and in cooperating relation with said second engaging means on said lid.

2. An improved container as in claim 1 wherein said first, arm rotation limiting means is disposed on said container wall adjacent the pivot end of said arm.

3. An improved container as in claim 2 wherein said second, handle engaging means comprises a groove in said outer lid surface adapted to matingly engage said handle crosspiece.

4. An improved container as in claim 3 wherein said third, outward handle rotation preventing means comprises a shoulder on said outer lid surface adjacent said groove adapted to provide a first, locking stop engageable with said handle crosspiece.

5. An improved container as in claim 4 wherein said container has at least one pair of opposed parallel walls and which lid includes a pair of sections, each lid section being pivotally mounted on said opposed walls, and which includes a pair of said handles, one of said pair being mounted on each of said opposed parallel walls.

6. An improved container as in claim 5 wherein said handles are pivotally mounted medially between said lid and said container bottom on said walls, and the length of said arms are shorter than the distance between said pivotal mounting point and said bottom to permit storage of said handle adjacent said wall.

7. An improved container as in claim 6 wherein said inner lid surface is recessed to permit retaining objects and prevent run-off of fluids.

8. An improved container as in claim 7 wherein said lid includes a plurality of recesses, at least one of which is circular.

9. An improved container as in claim 7 wherein said lid includes a plurality of recesses, at least one of which is rectangular.

10. An improved container as in claim 4 wherein said groove is generally V-shaped, with one side of said V providing a second stop shoulder spaced from said first stop, and said first and second stops are joined by the second side of said V groove which provides a support surface engageable with said crosspiece.

11. An improved container as in claim 5 wherein one of said lid sections contains at least one recess to provide a hand-hold to facilitate opening of said lid.

12. An improved container as in claim 1 wherein said first, arm rotation limiting means is disposed on said arm adjacent the pivot end thereof.

* * * * *